US008803079B2

(12) United States Patent
Antonov et al.

(10) Patent No.: US 8,803,079 B2
(45) Date of Patent: Aug. 12, 2014

(54) APPARATUS AND METHOD FOR ELEMENTAL ANALYSIS OF PARTICLES BY MASS SPECTROMETRY

(71) Applicant: DVS Sciences, Inc., Markham (CA)

(72) Inventors: Alexei Antonov, Toronto (CA); Dmitry Roman Bandura, Toronto (CA)

(73) Assignee: Fluidigm Canada Inc., Markham (CA)

( * ) Notice: Subject to any disclaimer, the term of this patent is extended or adjusted under 35 U.S.C. 154(b) by 0 days.

(21) Appl. No.: 13/900,306

(22) Filed: May 22, 2013

(65) Prior Publication Data

US 2013/0268211 A1 Oct. 10, 2013

Related U.S. Application Data

(60) Continuation of application No. 13/168,596, filed on Jun. 24, 2011, now Pat. No. 8,481,925, which is a division of application No. 11/838,353, filed on Aug. 14, 2007, now Pat. No. 8,283,624.

(60) Provisional application No. 60/837,605, filed on Aug. 15, 2006.

(51) Int. Cl.
*H01J 49/26* (2006.01)

(52) U.S. Cl.
USPC ..... 250/281; 250/282; 702/27; 702/28

(58) Field of Classification Search
USPC ..... 250/281, 282, 288; 702/27, 28
See application file for complete search history.

(56) References Cited

U.S. PATENT DOCUMENTS

| | | | |
|---|---|---|---|
| 4,022,876 | A | 5/1977 | Anbar |
| 4,490,806 | A | 12/1984 | Enke et al. |
| 4,583,183 | A | 4/1986 | Winiecki et al. |
| 5,367,162 | A | 11/1994 | Holland et al. |
| 5,559,337 | A | 9/1996 | Ito et al. |

(Continued)

FOREIGN PATENT DOCUMENTS

| | | | |
|---|---|---|---|
| WO | 9833203 | A1 | 7/1998 |
| WO | 2005003767 | A2 | 1/2005 |

(Continued)

OTHER PUBLICATIONS

Tanner, Space Charge in ICP-MS: Calculation and Implications, Spectrochimica Acta 1992 47B: 809-823, Canada.

(Continued)

*Primary Examiner* — Nicole Ippolito
(74) *Attorney, Agent, or Firm* — Senniger Powers LLP

(57) ABSTRACT

An apparatus for elemental analysis of particles such as single cells or single beads by mass spectrometry is described. The apparatus includes means for particle introduction; means to vaporize, atomize and ionize elements associated with a particle; means to separate the ions according to their mass-to-charge ratio; means to detect the separated ions, means to digitize the output of the means to detect the ions; means to transfer and/or to process and/or record the data output of the means to digitize, having means to detect the presence of a particle in a mass spectrometer; and means to synchronize one of the means for ion detection, data digitization, transfer, processing and recording with the means to detect the presence of a particle. Methods and computer readable code implementing aspects of the apparatus, and for reducing the rates of data generation, digitization, transfer, processing and recording are also described.

6 Claims, 13 Drawing Sheets

(56) References Cited

U.S. PATENT DOCUMENTS

| | | | | |
|---|---|---|---|---|
| 5,981,180 | A | 11/1999 | Chandler et al. | |
| 6,140,638 | A | 10/2000 | Tanner et al. | |
| 6,449,562 | B1 | 9/2002 | Chandler et al. | |
| 6,524,793 | B1 | 2/2003 | Chandler et al. | |
| 6,836,742 | B2 | 12/2004 | Brekenfeld | |
| 7,135,296 | B2 | 11/2006 | Baranov et al. | |
| 7,375,569 | B2 | 5/2008 | Hall et al. | |
| 8,101,368 | B2 | 1/2012 | Ornatsky et al. | |
| 8,283,624 | B2 * | 10/2012 | Antonov et al. | 250/281 |
| 8,481,925 | B2 | 7/2013 | Antonov et al. | |
| 2001/0050337 | A1 * | 12/2001 | Tanaka | 250/288 |
| 2002/0086441 | A1 | 7/2002 | Baranov et al. | |
| 2003/0111597 | A1 | 6/2003 | Gonin et al. | |
| 2004/0059519 | A1 | 3/2004 | Chandler et al. | |
| 2004/0072250 | A1 | 4/2004 | Baranov et al. | |
| 2004/0108452 | A1 | 6/2004 | Graber et al. | |
| 2005/0073683 | A1 | 4/2005 | Gard et al. | |
| 2005/0218319 | A1 | 10/2005 | Bandura et al. | |
| 2006/0003366 | A1 | 1/2006 | DiCesare | |
| 2006/0016977 | A1 | 1/2006 | Kawato | |
| 2006/0046254 | A1 | 3/2006 | Xie et al. | |
| 2006/0246530 | A1 | 11/2006 | Krause et al. | |
| 2006/0289747 | A1 | 12/2006 | Schultz et al. | |
| 2007/0046934 | A1 | 3/2007 | Roy | |
| 2007/0063139 | A1 * | 3/2007 | Hall et al. | 250/287 |
| 2007/0131849 | A1 | 6/2007 | Beaulieu et al. | |
| 2007/0189930 | A1 | 8/2007 | Ramiro Arcas et al. | |
| 2008/0176334 | A1 | 7/2008 | Baranov et al. | |
| 2012/0164632 | A1 | 6/2012 | Ornatsky et al. | |

FOREIGN PATENT DOCUMENTS

| | | | |
|---|---|---|---|
| WO | 2005123959 | A2 | 12/2005 |
| WO | 2006109073 | A2 | 10/2006 |
| WO | 2007093049 | A1 | 8/2007 |
| WO | 2007093050 | A1 | 8/2007 |
| WO | 2007137418 | A1 | 12/2007 |
| WO | 2007140571 | A1 | 12/2007 |
| WO | 2008080224 | A1 | 7/2008 |

OTHER PUBLICATIONS

Bandura, Effect of Collisional Damping and Reactions in a Dynamic Reaction Cell on the Precision of Isotope Ratio Measurements, The royal society of Chemistry 2000, published on the web Jul. 26, 2000, 921-928, Canada.

Cao, DNA-Modified Core—Shell Ag/Au Nanoparticles, J. Am. Chem. Soc. 2001, 123, 7961-7962, U.S.

Baranov, A Sensitive and Quantitative Element-Tagged Immunoassay with ICPMS Detection, Anal. Chem. 2000, vol. 74, No. 7, Apr. 1, 2002, published on web Feb. 22, 2002, p. 1629-1636, Canada.

Nomizu, Determination of Zinc in Individual Airborne Particles by Inductively Coupled Plasma Mass Spectrometry with Digital Signal Processing, The Royal Society of Chemistry 2002, published on the web May 9, 2002, Japan, pp. 592-595.

Baranov, The Potential for Elemental Analysis in Biotechnology, The Royal Society of Chemistry 2002, published on the web Jun. 18, 2002, pp. 1148-1152, Canada.

Quinn, Simultaneous Determination of Proteins Using an Element-Tagged Immunoassay Coupled with ICP-MS Detection, The Royal Society of Chemistry 2002, published on the web Jul. 2, 2002, pp. 892-896, Canada.

Zhang, ICP-MS-based Competitive Immunoassay for the Determination of Total Thyroxin in Human Serum, The Royal Society of Chemistry 2002, pp. 1304-1307, China.

Jakubowski, Metallobiomolecules. The Basis of Life, the Challenge of Atomic Spectroscopy, The Royal Society of Chemistry, published on the web Dec. 19, 2003, 4 pgs. Germany.

Merkoci, Toward an ICPMS-Linked DNA Assay Based on Gold Nanoparticles Immunoconnected Through Peptide Sequences, Analytical Chemistry, vol. 77, No. 19, Oct. 1, 2005, pp. 6500-6503, Spain.

Ornatsky, Multiple Cellular Antigen Detection by ICP-MS, Journal of Immunological Methods 308 (20006), available on the web Nov. 21, 2005, pp. 68-76, Canada.

Ornatsky, Messenger RNA Detection in Leukemia Cell Lines by Novel Metal-tagged in situ Hybridization using Inductively Coupled Plasma Mass Spectrometry, Translational Oncogenomics 2006, pp. 1-9, Canada.

Unwin, Relative Quantification in Proteomics: New Approaches for Biochemistry, Trends in Biochemical Sciences, vol. 31, No. 8, pp. 473-484, United Kingdom, Jul. 11, 2006.

Bettmer, Elemental Tagging in Inorganic Mass Spectrometric Bioanalysis, Anal Bioanal Chem (2006), 386: 7-11, published on the web Jul. 20, 2006, Germany.

Lou, Polymer-Based Elemental Tags for Sensitive Bioassays, Angew. Chem. Int. Ed. 2007, 46, 6111-6114, Canada.

Tanner, Multiplex Bio-Assay with Inductively Coupled Plasma Mass Spectrometry: Towards a Massively Multivariate Single-Cell Technology, published in Spectrochimica Acta Part B, published on the web Feb. 6, 2007, pp. 188-195, Russia.

Vancaeyzeele, Lanthanide-Containing Polymer Nanoparticles for Biological Tagging Applications: Nonspecific Endocytosis and Cell Adhesion, J. Am. Chem. Soc. 2007, 129 13653-13660, Canada.

Scheffer, ICP-MS as a New Tool for the Determination of Gold Nanoparticles in Bioanalytical Applications, Anal Vioanal Chem (2008) 390: 249-252, published on the web Sep. 15, 2007, Germany.

Tanner, Flow Cytometer with Mass Spectrometer Detection for Massively Multiplexed Single-Cell Biomarker Assay, Pure Appl. Chem. vol. 80, No. 12, pp. 2627-2641, 2008, Canada.

Ornatsky, Development of Analytical Methods for Multiplex Bio-Assay with Inductively Coupled Plasma Mass Spectrometry, J. Anal. At. Spectrom., 2008, 23, 463-469, published on the web Jan. 4, 2008, Canada.

Ornatsky, Study of Cell Antigens and Intracellular DNA by Identification of Element-Containing Labels and Metallointercalators Using Inductively Coupled Plasma Mass Spectrometry, Anal. Chem. 2008, 80, 2539-2547, Apr. 1, 2008, Germany.

Razumienko, Element-Tagged Immunoassays with ICP-MS Detection: Evaluation and Comparison to Conventional Immunoassays, Journal of Immunological Methods 336 (2008) 56-63, Canada.

Jakubowski, Labelling of Proteins with 2-(4-isothiocyanatobenzyl)-1,4,7,10-tetraazacyclododecane-1,4,7,10-tetraacetic acid and lanthanides and Detection by ICP-MS, J. anal. At. Spectrom, 2008, 23, 1497-1507, published on the web Aug. 28, 2008, Germany.

Jakubowski, Labelling of Proteins by Use of Iodination and Detection by ICP-MS; J. Anal. At. Spectrom, 2008, 23 1487-1496, Germany.

International Search Report, PCT/CA2007/001419, dated Nov. 28, 2007, 5 pages.

Written Opinion of the International Searching Authority, PCT/CA2007/001419, dated Nov. 28, 2007, 6 pages.

* cited by examiner

APPARATUS AND METHOD FOR ELEMENTAL ANALYSIS OF PARTICLES BY MASS SPECTROMETRY

CROSS-REFERENCE TO RELATED APPLICATION

This application is a continuation patent application based on U.S. application Ser. No. 13/168,596, filed Aug. 11, 2007 Jun. 24, 2011, which is a divisional application based on U.S. application Ser. No. 11/838,353, filed Aug. 14, 2007, which is now U.S. Pat. No. 8,283,624, which claims the benefit of U.S. Provisional Application No. 60/837,605, filed Aug. 15, 2006, the entire contents of which are each incorporated by reference, including all appendices and other documents attached thereto.

INCORPORATION BY REFERENCE

This application incorporates by reference:

U.S. Patent Publication No. 200510218319 entitled "Method and apparatus for flow cytometry linked with elemental analysis" published 6 Oct. 2005;

U.S. Pat. No. 4,490,806 issued 25 Dec. 1994;

U.S. Pat. No. 4,583,183 issued 15 Apr. 1986;

U.S. Pat. No. 5,367,162 issued 22 Nov. 1994;

U.S. Provisional Application No. 60/772,589 entitled "Quantitation of cell numbers and cell size using metal labeling and elemental mass spectrometry" filed 13 Feb. 2006;

Ornatsky et al., Journal of Immunological Methods 308, 68 (2006);

Sirard et al., Blood, 83, 1575 (1994);

PDA 1000 1 GHz Waveform Digitizer Product Information Sheet, Signatect Inc., 1138 E. Sixth Street, Corona, Calif. 92879-1615, U.S.A.; and Piseri et al., Review of Scientific Instruments, 69, 1647 (1998), including all appendices and other documents attached thereto.

FIELD OF THE INVENTION

The invention relates to elemental analysis of particles by mass spectrometry.

SUMMARY OF THE INVENTION

The invention provides systems, methods, devices, and computer programming useful for, among other purposes, operating a mass spectrometer and tending to reduce mass spectrometry data generation rate, and/or for reducing the amount of data intended for processing, such as for storing in a computer volatile memory and for recording into a computer non-volatile memory, during the analysis of individual particles. The described system and methods operate can operate with a mass analyzer that provides for temporal separation of charged particles within a flow of charged particles, based on mass and/or mass-charge ratio. The individual particles include, for example, biological cells that contain elemental information, or elementally-coded beads. However, the invention is relevant to the analysis of any kind of small particles.

For example, in one aspect the invention provides methods and means for operating a detection system for mass spectrometry of individual particles using a time-of-flight mass spectrometer. In particular, the invention provides methods for reducing the TOF-MS data generation rate by sampling of the TOF-MS detector waveform predominantly in one or more primary mass-to-charge ratio channels for most mass spectrometer sampling cycles and initiate sampling in the other than primary mass-to-charge ratio channels only when the data obtained for the primary mass-to-charge ratio channels satisfy predetermined selection criteria. The data can be sampled in one or more single sampling cycle mass spectra as appropriate for a desired application.

The time window which is sampled in each single TOF-MS spectrum can correspond to the time window in which the ions of a staining element that is present in the cell or the particle being characterized and is relatively absent in the absence of the cell or the particle, can produce a signal at the TOF-MS detector. In the event that the signal within this time window is above a certain threshold (i.e. the staining element is present), the presence of a particle in the mass spectrometer is recognized and detection is activated in at least one other time window. This detection in the other time window(s) can be activated for the same single mass spectrum, if the "staining" element characterizing the presence of the cell or the particle is the lightest among the elements of interest and thus arrives at the detector before other ions of interest. Alternatively, detection in the other time window(s) can be activated for a set number of consecutive single spectra, or until the "staining" element signal falls below a designated threshold, thus allowing detection of any number of elements of interest from the cell, including those that are lighter than the "staining" element. "Staining" of the cells can be achieved by any method consistent with the processes and objectives disclosed herein, including for example the method described in U.S. provisional patent application Ser. No. 60/772,589 filed Feb. 13, 2006 "Quantitation of cell numbers and cell size using metal labeling and elemental mass spectrometry" by Ornatsky and Baranov, which is incorporated here by reference. There can be more than one staining element which indicates that a particle to be analyzed is present in the mass spectrometer. In such case, analysis of the particle can be activated on a condition that a pre-selected function of the signals of the detected staining elements (for example, the sum of the intensities of the staining elements signals) satisfies pre-defined criteria.

The methods of the present invention can be employed to significantly reduce the rate of data generation by detecting only a small part of the full mass spectra between the particle-induced events. The data generation rate is thus better suited for data transfer without loss of significant data. The presence of the staining element is detected either by the TOF-MS detector or independently of the TOF-MS detector means.

In an aspect of the invention, the signal that indicates the presence of a particle in the mass spectrometer can be detected by other elements that the main ion detector which provides mass resolved data. In such case, the system can comprise one or more auxiliary detectors. This signal can be induced by ions, photons or electrons produced by the ion source, or by a neutral component of the particle which survived through the ion source in un-ionized state.

In another aspect of the invention, the time window which is sampled in each single mass spectrum, contains all expected times of arrival of the ions of interest (i.e., all mass-to-charge ratio channels of interest), including the ions of staining elements. However, only the data from the primary mass-to-charge ratio channels, which can be referred to as a primary detection group, that correspond to one or more particle staining element, are transferred for further processing. Only when the data from these first time windows satisfies pre-defined selection criteria, the data from other time windows, which can be referred to as a secondary detection group, are transferred for further processing. As a result, the amount of data which is always processed can be kept low and only increases to process a more detailed set of data/information only in the event when the primary time windows data indicate the presence of the particle.

In another aspect of the invention, the time window which is sampled in each single mass spectrum contains all mass-to-charge ratio channels of the ions of interest, including the ions of staining elements. All data from the time window is transferred and processed for each single mass spectrum, the processing including, for each mass-to-charge ratio, ion counting or summing of all signals within the pre-selected time window corresponding to a particular mass-to-charge ratio. The resulting data contain for each single mass spectrum a plurality of single integral values of a signal strength for each mass-to-charge ratio. Only when the processed data in the mass-to-charge ratio channels selected as a primary detection group satisfy pre-selected criteria, the processed data for the single mass spectrum is stored.

In another aspect of the invention, the criterion for selecting the data as eligible for sampling, transfer, processing or recording involves the data from the primary time windows from more than one sequential single mass spectrum, for example, from a group of consecutive mass spectra duration of which is approximately the same as the duration of the presence of the particle or particle-induced ion cloud in the mass spectrometer.

Another aspect of the invention provides a mass spectrometer for elemental analysis of individual particles, which comprises means to introduce particles into the mass spectrometer, an ion source to vaporize, atomize and ionize at least some of the elements associated with the particle, a mass analyzer to separate the ions according to their mass-to-charge ratio, an ion detector to detect the mass-to-charge separated ions, a digitizing system to digitize the output of the ion detector, means to transfer, process and record the data, means to detect the presence of a particle in the mass spectrometer, and means to synchronize at least one of the ion detector, the digitizing system, or the means to transfer, process and record the data with the means to detect the presence of the particle in the mass spectrometer.

BRIEF DESCRIPTION OF THE DRAWINGS

The foregoing and other aspects of the invention will become more apparent from the following description of specific embodiments thereof and the accompanying drawings which illustrate, by way of example only, the principles of the invention. In the drawings, where like elements feature like reference numerals (and wherein individual elements bear unique alphabetical suffixes):

FIGS. 8A-1 through 8A-5 and 8B show results of application of the exemplary method shown in FIG. 7 to the data processing of the experimental data for biological cells stained with Ir and immuno-stained with Tb-CD-45, Ho-CD-38 and Tm-CD-34 antibodies, with FIG. 8A-1 through 8A-5 showing all the data obtained for 165000 single sampling cycle mass spectra, and FIG. 8B showing the data processed according to a method of the invention.

DEFINITIONS

Figure 1:
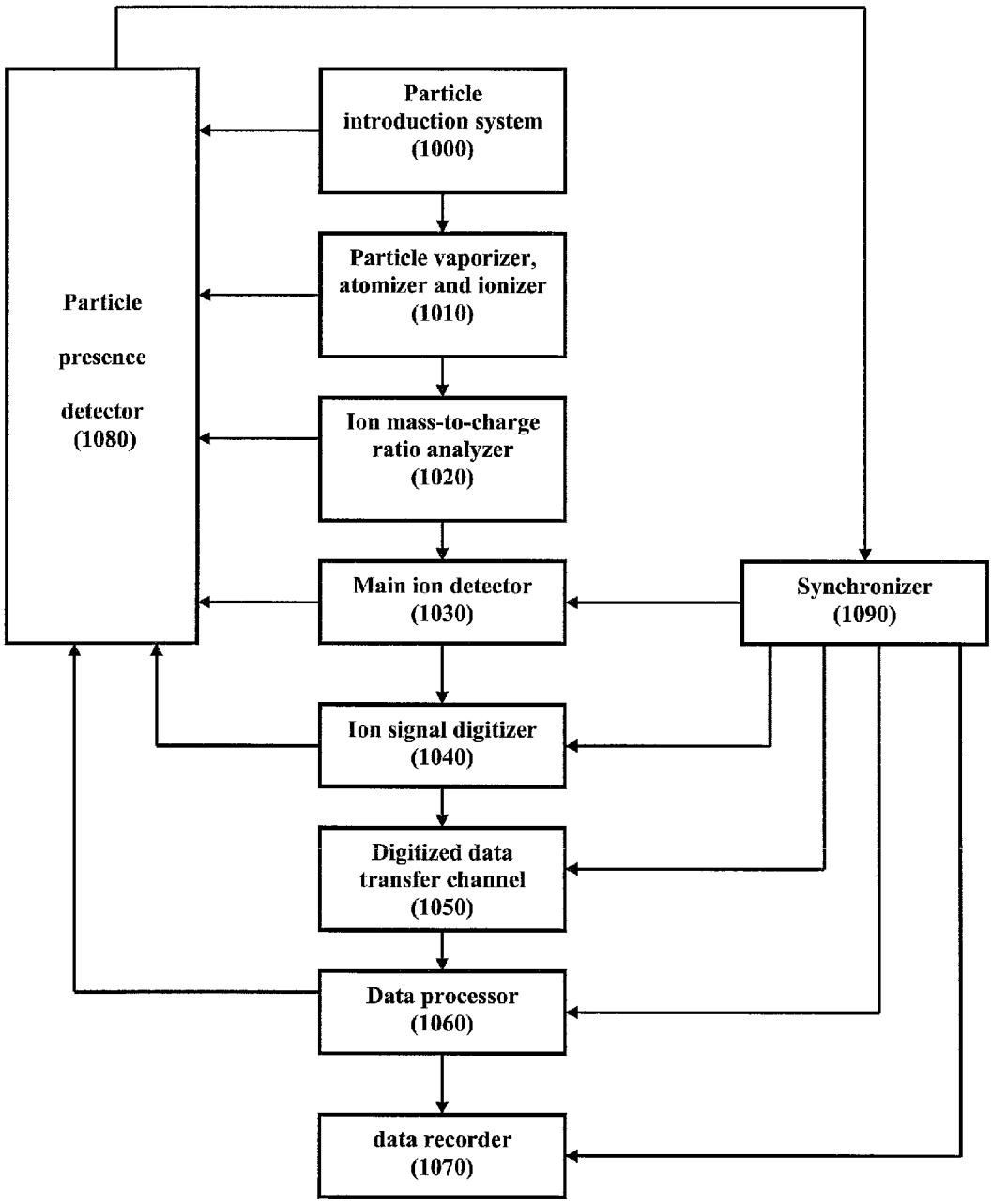
FIG. 1 shows a block-diagram of an exemplary apparatus according to the invention.

Staining element: is any atomic element or isotope present in the particle or biological cell which can be analyzed by the disclosed apparatus and method. The element can be naturally present in the cell or particle, or can be an element that is purposely added to the cell or particle. For example, some cells may be abundant in Zn or Fe. Alternatively, a staining element can be specifically added (or tagged) into the cell or particle, by any method consistent with the disclosure herein, including but not limited to using a metalointercalator to label the DNA or permeated into the cell or added by an element-tagged antibody.

Presence of a particle in a mass spectrometer: includes the fact of presence of the particle itself or observable effects induced by the particle. For example, characteristics of an inductively coupled plasma ion source can change when a particle or a biological cell passes through the inductively coupled plasma. Such characteristics can include, but are not limited to, changes in the light emission characteristics of the plasma due to suppressed excitation of the plasma gas or excitation of species present in a cell or a particle, changes of an electrical parameter of the plasma as a consequence of the passage of a particle or a biological cell through the plasma, or changes in the radio-frequency or in the direct current potential in or in the vicinity of the plasma. One of the processes, or effects, induced by a particle is an ion cloud produced from the material associated with the particle, which, when detected, indicates the presence of the particle in the mass spectrometer.

A single mass spectrum can include a waveform and raw and processed data associated with the waveform, that are collected in a single sampling cycle for example after a single ion beam modulation event is applied in a mass spectrometer (such as an exemplary time-of-flight apparatus described below). For example a packet of ions in the acceleration region pushed by appropriately arranged electrical pulses into the flight tube. This can also be referred to as single sampling cycle mass spectra.

Time-of-flight cycle is the period between consecutive single ion beam modulation events.

Elemental code is a composition of a particle or cell with respect to at least two isotopes of the same or different elements that are present at a known or preset ratio of abundances and that distinguish the particle or cell from particles or cells of a different type. The isotopes may occur naturally in the particle or cell, or may be purposely introduced in the manner described for a staining element.

Ion detector includes any or all devices capable of collecting one or more mass spectra, or of collecting signals induced by a staining element.

Data generation rate is the rate at which the digitized representation of a single mass spectrum is produced. For example, if a waveform representing a single mass spectrum is of the duration of 10 microseconds, and its features require sampling of the waveform with accuracy of $10^{-2}$% in time and 0.4% in signal strength, the waveform needs to be sampled every 1 nanosecond and with 250 levels of signal strength, resulting in approximately 10000×8 bit=10 kilobyte (kB) of data in 10 microsecond, or 1 gigabyte (GB) per second data generation rate.

Data transfer rate is the rate at which a digitized representation of a single waveform can be transferred into a memory storage device for further processing, including for example compression or recording.

Spectrum generation frequency is the frequency at which consecutive single mass spectra are generated.

A particle is any discrete object of a size suitable for mass analysis by a mass spectrometer. For example, metal or metal oxide powders used in different technological processes can consist of 10 nm-100 μm particles. Other examples of particles include viral micro-organisms (viruses), debris of biological cells, whole biological cells, groups of biological cells etc.

DETAILED DESCRIPTION OF THE PREFERRED EMBODIMENTS

The description which follows, and the embodiments described herein, are provided by way of illustration of examples of particular embodiments of the principles of the present invention. These examples are provided for the purposes of explanation, and not limitation, of those principles and of the invention.

Although the following description provides examples of embodiments of the invention in Time-of-Flight mass spectrometry applications, it will be appreciated that in other embodiments, other mass spectrometers may be employed, including static mass spectrometers that separate ions of different mass-to-charge ratio by spatial dispersion, for example, magnetic sector mass spectrometers. Other mass spectrometers considered are dynamic mass spectrometers that scan parameters of the analyzer in time in order to transfer ions of different mass-to-charge ratio to a detector at different times. In the description that follow, a detection region of a mass spectrometer can include, depending on the particular embodiment, the time frame or space frame for detecting ions in a mass spectrometer. A sampling window is a subset of the detection region, which for example can be a time window that is smaller than the period of a sampling cycle in an embodiment employing Time-of-Flight mass spectrometry, or a part of a scan function of the analyzer parameters in the case of dynamic mass spectrometers like those based on RF quadrupoles or on various types of ion traps. In exemplary embodiments utilizing mass spectrometers dispersing ions in space, the detection region can be an ion detector of the mass spectrometer, with a sampling region being a limited portion of the ion detector, or, in case of the instrument with plurality of ion detectors, a sub-set of ion detectors.

Apparatus according to the invention can be described with reference to FIG. 1. A particle to be analyzed by the apparatus is introduced by the particle introduction system 1000. The material associated with the introduced particle is vaporized, atomized and ionized by the particle vaporizer, atomizer and ionizer 1010, and ions associated with the particle are produced. The ions are separated according to their charge-to-mass ratio by the Ion mass-to-charge ratio analyzer 1020, and the separated ions are detected by the main ion detector 1030. During times when there is no particle introduced or present in the system, a particle presence detector 1080 does not detect the presence of a particle. During such times, data collected by the main ion detector 1030, digitized by the digitizer 1040, transferred by the digitized data transfer channel 1050, processed by the data processor 1060, and/or stored by the data recorder 1070, is minimal and limited to the data which can be used for the detection of the particle. For example, the detector can be operated within a time window in which only some ions associated with the particle, for example, ions of the staining element, can be detected.

Alternatively or in addition, the data digitizer 1040 can be operated to digitize only the data which originated from within the time window where, for example, the staining element can be detected. Alternatively or in addition, the data transfer channel 1050 can transfer only data which originated from the time window in which the ions of the, for example, staining element can be detected. Alternatively or in addition to the above, the data processor can process only the data which originated from the time window where, for example, the staining element can be detected. Alternatively or in addition, the data recorder stores only the data which originated from within the time window where, for example, staining element can be detected.

The particle presence detector detects the presence of particles in the system by detecting signals induced by either ions, neutrals or electrons associated with the particle. The signals can be detected by the components of the particle presence detector 1080 which are distinct from the main ion detector 1030, or which can use the minimal data collected by the main ion detector 1030. The particle presence can also be detected by the particle presence detector 1080 with the use of the data digitized by the data digitizer 1040 or by use of the data processed by the data processor 1060. When the presence of a particle is detected, synchronizer 1090 can be activated and commands one or more of the ion detector 1030, ion signal digitizer 1040, digitized data transfer channel 1050, data processor 1060 and/or data recorder 1070 to either detect ions from a wider time window or from additional time windows, to digitize ion signals from a wider time window or additional time windows, to transfer the data originating from a wider time window or additional time windows, to process data originating from a wider time window or additional time windows, and/or record data from a wider time window or additional time windows.

Synchronizer 1090 therefore can be used to synchronize one or more other components of the mass spectrometer with the presence of the particle. For example, if a particle is present, such synchronization can be to permit detection of more ions, such as in a secondary detection group or channels (as described in more detail below). Additionally, if a particle is present, it can be to digitize more data (such as data that are already detected in full). Further, if a particle is present, it can be to transfer more data (such as data already detected and digitized in full). Still further, if a particle is present, it can be to process more data (such as data that is already detected, digitized and transferred in full). Further still, if a particle is present, it can be for recording more data (again, such as data that is already detected, digitized, transferred and processed in full). As examples, the benefits of data savings can be performed at different stages of the data collection, digitization, transfer, processing or recording, as synchronized by synchronizer 1090.

With reference now to a specific type of embodiment, the detection of ion signals and data processing in Time-of-Flight (TOF) Mass Spectrometry, and in particular methods of operation of a detection system and apparatus for collecting and storing Time-of-Flight Mass-Spectrometry data for analysis of individual particles, is described below.

Time-of-Flight Mass Spectrometers (TOF MS) operate on the principle of measuring the time which ions travel over a fixed distance, the time being usually proportional to the square root of the mass-to-charge ratio of an ion and thus being a measure of the mass of a detected ion. Ions that arrive at an ion detector produce detector output signals which usually consist of a sequence of peaks each representing one or more ions of a particular mass-to-charge ratio (m/z). Generally, the duration of each peak in the mass spectrum is less than 100 nanosecond, and the total duration of the detector output signal which represents ions of all masses (usually called single mass spectrum) is of the order of 100 microsecond. Such detector output signals are usually digitized in one of two distinct ways: time-to-digital conversion or transient recording. In a time-to-digital converter (TDC), a counter associated with each arrival time window is incremented when an event of ion arrival is detected within this window. All events of ions arriving at a detector within a certain time period (called "dead time" of the TDC, typically 5-20 ns) can only be counted as one event. As a result, the TDC technique, being an ion counting technique, has been limited by the measurement time dynamic range and is not generally suitable for high dynamic range characterization of rapidly changing ion beams.

One example of a rapidly changing ion beam occurs when a small particle is ionized and produces an ion cloud that rapidly changes in composition and/or ion density. TOF MS is an example of a preferred method of analysis of ion clouds, in a flow cytometer instrument with a mass spectrometer detector that measures elemental composition of a single biological cell, or a single bead particle, specifically for elements that are attached to antibodies or other affinity reagents conjugated to their specific antigens, as described in the US patent application No. 20050218319 A1 "Method and apparatus for flow cytometry linked with elemental analysis", published on Oct. 6, 2005. The typical duration of an ion cloud produced from such a cell or bead in the ICP is 100-200 microsecond. It is desirable to be able to analyze such a short ion cloud for ions of multiple m/z with dynamic range of at least 4 orders of magnitude.

Another way of digitization of the detector output signal is the use of a transient recorder, in which all of the information in the signal that represents a single TOF mass spectrum (single transient) is captured and stored. For example, transient recorders, based on analog-to-digital converters (ADC), are encountered in commercial Digital Storage Oscilloscopes.

It can be desirable in some circumstances to provide information about the change in elemental composition of a particle-produced ion cloud during transient periods which can last, for example, 100-200 microseconds. In such circumstances it can be desirable to collect and store multiple mass spectra during such a relatively short period. The duration of a single mass spectrum can desirably be of the order of 10-20 microsecond, allowing 5-20 spectra to be collected for a single particle ion cloud. A typical width for a single mass window in elemental TOF with a single mass spectrum duration of approximately 20 microsecond is 10-15 ns. A sampling rate of 1 GHz or better can thus be desirable for characterizing ion peak shapes. Such a high sampling rate and $10^4$ dynamic range requirement results in a data generation rate well in excess of 1 GB/s. This is much higher than the fastest data transfer rate (~250 MB/s) achievable with technology known in the art.

One of the ways known in the art to match a high data generation rate with slow data transfer capabilities such as those of the current technology is to use integrating transient recorders, such as those described in U.S. Pat. No. 4,490,806, issued Dec. 25, 1984. In such devices, information from each single mass spectrum is collected and then the information from multiple sequential transients is summed in a high speed memory register bank in a time-locked manner. Two or more parallel memory banks can be used, with one bank used for integrating the data while another one is used for the data read-out and transfer. However, with such methods, information from individual mass spectra can be lost, so it is not suitable for tracking compositional changes between individual mass spectra occurring during analysis of very short duration ion clouds.

Another way to match high data generation rates with slow data transfer capabilities is to filter the acquired data according to chosen selection criteria, transferring only the data to be stored and discarding the data to be ignored.

In a related technology, the signal detector means is turned on in each mass spectrum only for a data collection time window beginning just prior to the expected arrival time of each of the plurality of the expected ion peaks, as described, for example, in U.S. Pat. No. 5,367,162 issued Nov. 22, 1994. In another technology, described in the U.S. Pat. No. 4,583,183 issued Apr. 15, 1986, programmable masking means masks in each mass spectrum the information from the time windows in which the data are to be ignored. For such devices, to achieve significant reduction of data generation rates, data in each single mass spectrum which is to be stored need to be separated by relatively long time windows from the data to be ignored. For example, a 10-fold reduction in data requires that in each single mass spectrum, the mass peaks of 20-50 ns duration be separated by 0.2-0.5 microseconds. For a single mass spectrum of 10-20 microsecond duration, which is needed for the sampling of very short transients from individual particles, the mass peaks of interest can be spaced much closer in time.

In one type of embodiment, a time-of-flight mass spectrometer is provided, in which a method, and corresponding computer program code, are implemented for sampling signal waveforms generated by the ion detector in predefined time windows on each of the single time-of-flight spectrum generation events, and where sampling of a signal waveform generated by the ion detector in at least one additional time window is provided in the event that the sampled signal in the first window is above a pre-selected threshold.

Figure 2:
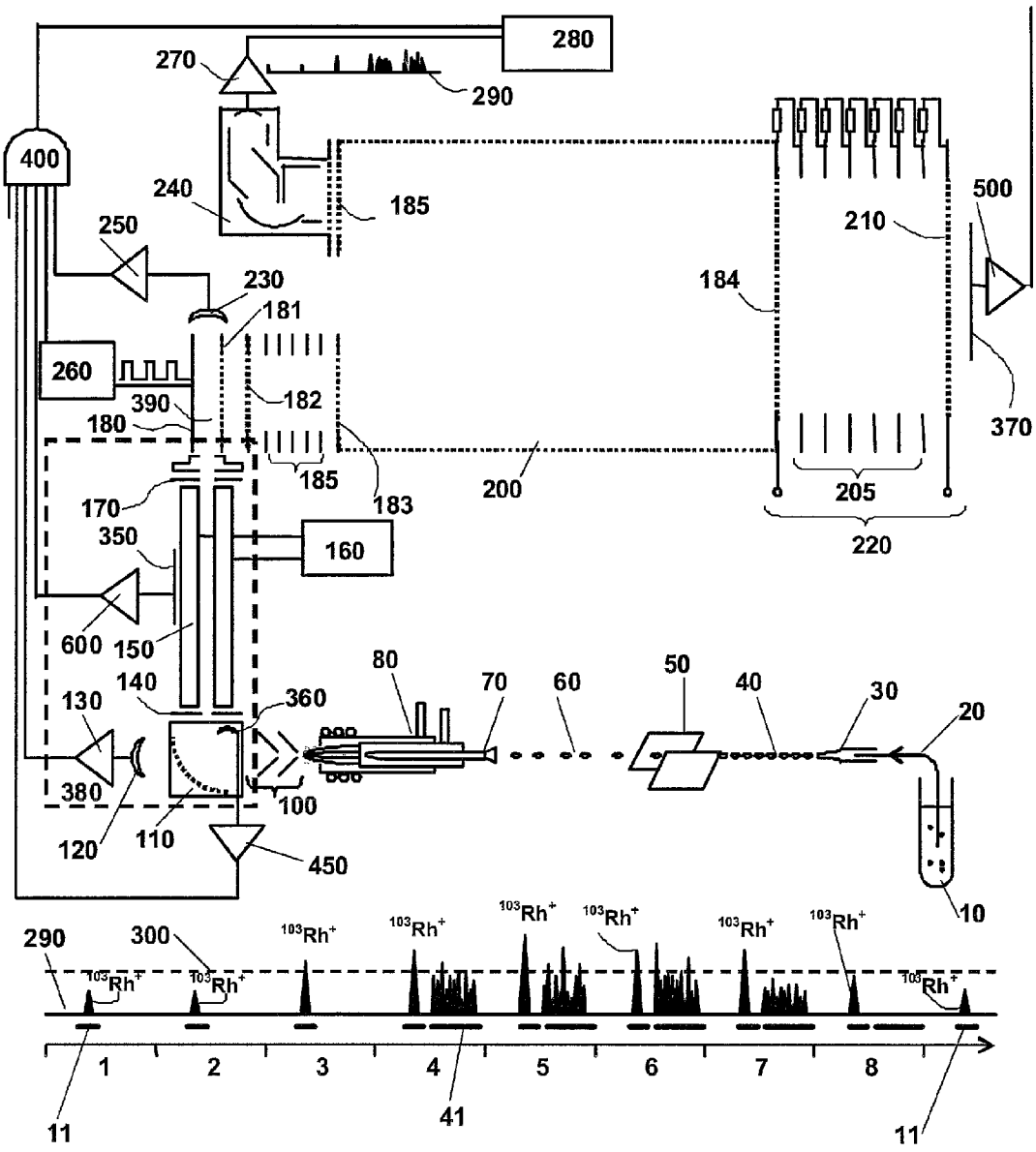
FIG. 2 is a schematic diagram of an example of a time-of-flight mass spectrometry apparatus suitable for analysis of individual cells, beads or other particles in accordance with the invention.

Description of such embodiments may be provided by using the example of a Time-of-Flight Mass Spectrometer schematically shown in FIG. 2. FIG. 2 shows an example of a schematic of a mass spectrometry-based flow cytometer suitable for use in implementing various aspects of the invention. A sample 10, which can, for example, comprise a suspension of biological cells, is introduced through sample introduction means 20 into a droplet generator 30 which produces droplets 40 at least some of which contain single cells. Means 50 for deflecting the unwanted droplets are provided which allow only wanted droplets 60 into the injector 70 of the inductively-coupled plasma source 80, where at least part of the material comprising cells is vaporized, atomized and ionized.

Ions from the cell material are introduced through a differentially pumped interface 100 into the ion transport section 380 which can comprise an ion deflector 110, apertures 140, 170, an RF ion guide 150 connected to the means of generation of the necessary RF and/or dc voltages 160. This section may include one or more ion collectors 120, 360, 350, connected to at least one signal handling means 130. Ion deflector 110 can deflect at least a portion of the ions towards the ion guide 150, which can transfer at least some ions through a set of ion optics 170 into the orthogonal accelerator 390, which can comprise a push-out plate 180, grids 181, 182, 183 and a set of rings 185. In a usual operation, voltages are applied to the elements that comprise the ion transport section 380 from the appropriate voltage supplies (not shown) in such a manner that a significant portion of the ions of interest are transported into the orthogonal accelerator 390.

At the start of each time-of-flight cycle, a short push-out voltage pulse can be applied to the push-out plate 180, and pull-out voltage pulse may be simultaneously applied to the grid 182; both can be supplied from the pulsing electronics 260. Such pulses can cause ions present between the plate 180 and the grid 181 to travel sideways through the accelerator 390, towards the grid 183, producing a short in the sideways direction packet of ions that consists predominantly of the ions that were between the plate 180 and the grid 181 at the time of application of the pulses. The ions then can travel through a field-free space 200 towards the ion reflector 220 which can comprise grids 184 and 210 and rings 205. At least some of the ions can be reflected back and then travel in the field-free space 200 through the grid 185 into the ion detector 240, in which the ions produce electron pulses which can be amplified by an amplifier 270, producing an ion signal waveform corresponding to a single spectrum.

The ions' arrival time at the detector depends on their mass-to-charge ratio, m/z. The ions with the largest m/z arrive at the detector latest. After a time interval sufficient for the latest of the ions of interest to arrive at the detector, the cycle may be initiated again by application of another set of pulses to the plate 180 and the grid 182, which are kept between pulses at voltages appropriate to allow at least some newly delivered by the ion transport section 380 to travel between the plate 180 and the grid 182. Several consecutive such ion signal waveforms that are acquired on several consecutive time-of-flight cycles are shown as 290. Time-of-flight instruments known in the art sample consecutive single spectra completely, for example, by analog-to-digital conversion of complete ion signal waveforms, and transfer digitized data describing such waveforms. In some embodiments, instruments can include means 280 that can sample every ion signal waveform predominantly in a relatively short time window that corresponds to the arrival time of the staining element(s).

For instruments such as that shown in the example, Rh can be selected as the staining element; however, any other element inherently present or artificially incorporated into the cell, can be used. The means 280 sample the single ion spectra predominantly in the time window 11 that corresponds to the arrival time of Rh+. After the signal strength in the time window 11 exceeds a pre-selected threshold 300, means 280 can start to sample single ion spectra additionally in at least one more time window 41. Alternatively, instead of two or more time windows, a single, longer time window can be chosen for sampling. After a pre-selected number of single spectra are sampled in two or more time windows (or a wider single time window), a short window sampling in a time window 11 can resume. Alternatively, multiple-window sampling (or the longer window sampling) can continue until the signal in the time window 11 falls below the pre-selected threshold 300. Since time window 11 can be significantly shorter than a single time-of-flight cycle (i.e., the period of a sampling cycle), the amount of digital data generated can be significantly reduced, and thus data transfer can occur in real time, without information loss [for data of interest].

In another mode of operation of an instrument according to such an embodiment, voltages supplied to one or more of the ion transport section 380, the RF ion guide 150, the orthogonal accelerator 390 and the reflector 220 can be applied in such a manner that the presence of a staining element can be detected with use of one or more of ion collectors 120, 230, 350, 360, 370. Signals indicating the presence of staining elements, after amplification and shaping by the signal handling means 130, 250, 600, 450 and 500, respectively, can be inputted into a logical device 400, which can generate a triggering pulse to initiate sampling of the ion signal waveform in one or more time windows by the means 280. Voltages applied to one or more of the ion transport section 380, the rf ion guide 150, the orthogonal accelerator 390 and the reflector 220 can be changed after the ions from the cell materials have produced signals on one or more of the collectors 120, 230, 350, 360, 370, in order to provide better transport of the ions of interest to the detector 240 after the staining element is detected. Operating an instrument in such a mode can allow sampling of the ion signal waveform predominantly when the cell or other particle of interest is present, and not sampling the ion signal waveform when it is absent, thus reducing the amount of generated data.

In another mode of operation, the instrument is operated with one long sampling window or with a plurality of sampling windows, which correspond to or cover arrival times for ions of all mass-to-charge ratios of interest. However, only data from the shorter time window 11, which corresponds to a primary detection group of mass-to-charge ratio channels, is transferred for further processing. In the event that such processing reveals that data in the sampling window satisfy certain criteria (indicating that a particle is present in the system, for example, by signal strength for Rh+ or other staining element being above certain threshold), data from other sampling windows, such as for a secondary detection group of mass-to-charge ratio channels, can be transferred. An advantage of such mode is that the average data transfer rate can be reduced.

In another mode of operation, all data obtained as described in the previous paragraph is transferred; however, only data from the primary mass-to-charge ratio channels is used for processing. In the event that processing reveals that data in the primary mass-to-charge ratio channels satisfy certain criteria (indicating that a particle is present in the system, for example, by signal strength for Rh+ or other staining element being above certain threshold), data from other sampling windows can be processed. Thus the average load on the processor can be reduced.

In another mode of operation, all the data obtained as described in the previous paragraph is transferred and processed; however, only in the event that data in primary mass-to-charge ratio channels satisfies pre-selected criteria, is the data stored in a non-volatile memory. Thus the average load on the disk recording system is reduced.

In another embodiment, a method of elemental analysis of particles by mass spectrometry is provided, comprising the steps of a) defining a primary detection group consisting of one or more mass-to-charge ratio channels of a mass spectrometer based on anticipated elements associated with the particle;

b) defining a secondary detection group consisting of one or more different to the first detection group mass-to-charge ratio channels of the mass spectrometer;

c) defining a function having as arguments the data collected in the primary detection group in one or more sampling cycles;

d) defining at least one selection criterion for evaluating the function as indicating a presence of a particle in the mass spectrometer;

e) acquiring the first data in the plurality of mass-to-charge ratio channels of the mass spectrometer which includes at least the primary detection group, for at least one sampling cycle;

f) in the event that the value of the function of the first data satisfies the pre-defined selection criteria, use the data from one or more of the first and the second detection group for the analysis of the particle.

In some embodiments, data observed from the secondary detection group of channels can also be used in the detection of particles, for instance, such as when selection of the primary detection group of channels appear to be insufficient for detection of the particle presence, the secondary group data may be used. Additionally, in an embodiment there can also be a wide detection time window which can include both primary and secondary detection groups. Even in these embodiments, the data processing and/or recording rate can be reduced, since the data in both detection groups or wider window would have already been collected

EXAMPLES OF OPERATION OF EMBODIMENTS

Example 1

Reduction of data generation rate for apparatus operating at a spectra generation frequency of 20 kHz.

In a particular embodiment cells can be stained with DNA-specific metal intercalator labeled with rhodium, as described in US patent application No. U.S. 60/772,589. Rh is a single isotope element which can be detected at m/z=103.

In the TOF-MS apparatus of a particular geometry with the parameters as per Table 1, in which the device reference numbers 180, etc., correspond to reference numbers shown in FIG. 2, the calculated expected pre-selected time window within which most of Rh+ ions arrive at a detector is 12 nanosecond wide, spanning from 32.970 to 32.982 microsecond. Calculated expected times of arrival for other elemental ions of interest for detection in cells span from 33 to 46 microsecond (Table 2). The spectrometer can be operated at 20 kHz spectrum generation (push-out) frequency, thus an ion cloud of 100-200 microsecond duration can be sampled with 2-4 single spectra. The detector output signal can for example be sampled and digitized only in the time window of 12 nanosecond duration, which can be arranged by any method compatible with the purposes described herein, including, for example, by means that generate the trigger pulse for activating ADC acquisition or sampling which is delayed by 32.970 microseconds from the spectrum start trigger. The length of the record can be set to be only 12 points, with sampling frequency of the ADC of 1 GHz.

In an event that the staining element is detected in a time-of-flight cycle (with sampling of the ion signal waveform performed within only 12 ns time window), the sampling of the ion signal waveform in a time window spanning from 33 to 50 microsecond can be activated for the next time-of-flight cycle, so that the second half of the 100 microsecond long ion cloud induced by the cell event may be sampled for all elements above 100 a.m.u. If the cells are introduced at 1000 Hz frequency (as is desired in mass spectrometry based flow cytometry), the average data generation rate is then 20.9 MB/s, which can be handled by the fast data transfer.

TABLE 1

Parameters of the instrument operated at 20 kHz push-out frequency

| | |
|---|---|
| Plate 180-Grid 181 distance/mm | 4.4 |
| Grid 181-Grid 182 distance/mm | 5 |
| Grid 182-Grid 183 distance/mm | 50 |
| Grid 183-Grid 184 distance/mm | 715 |
| Grid 184-Plate 210 distance/mm | 350 |
| Grid 184-Grid 185 distance/mm | 730 |
| Plate 180 potential/V | 350 |
| Grid 181 potential/V | 0 |
| Grid 182 potential/V | −391 |
| Grid 183 and Liner 200 potential/V | −4000 |
| Plate 210 potential/V | 350 |

TABLE 2

Calculated arrival time windows and segment start and stop times for the instrument of parameters as per Table 1.

| Segment # | Elements | Isotopes m/z | Segment start time/micro-second | Segment stop time/micro-second | Number of sample points |
|---|---|---|---|---|---|
| 1 | Rh | 103 | 32.97 | 32.982 | 12 |
| 2 | Ag | 107 | 33.604 | 33.616 | 12 |
| 3 | In | 115 | 34.839 | 34.851 | 12 |
| 4 | La | 139 | 38.303 | 38.315 | 12 |
| 5 | Ce | 140 | 38.44 | 38.453 | 13 |
| 6 | Pr | 141 | 38.575 | 38.59 | 15 |
| 7 | Nd | 144 | 38.984 | 38.999 | 15 |
| 8 | Sm | 152 | 40.052 | 40.067 | 15 |
| 9 | Eu | 153 | 40.184 | 40.199 | 15 |
| 10 | Tb | 159 | 40.964 | 40.979 | 15 |
| 11 | Dy | 164 | 41.604 | 41.619 | 15 |
| 12 | Ho | 165 | 41.73 | 41.745 | 15 |
| 13 | Er | 166 | 41.856 | 41.872 | 16 |
| 14 | Tm | 169 | 42.233 | 42.249 | 16 |
| 15 | Yb | 174 | 42.852 | 42.868 | 16 |
| 16 | Lu | 175 | 42.975 | 42.992 | 17 |
| 17 | Hf | 180 | 43.585 | 43.602 | 17 |
| 18 | Re | 187 | 44.423 | 44.44 | 17 |
| 19 | Ir | 193 | 45.13 | 45.149 | 19 |
| 20 | Pt | 195 | 43.363 | 45.382 | 19 |
| 21 | Au | 197 | 45.596 | 45.615 | 19 |

In other embodiments, sampling in multiple short time windows may be activated, the time windows being defined by elements of interest that are expected to be present in cells. Multiple elements can be artificially incorporated into cells simultaneously by tagging affinity reagents, in order to perform a multilex single cell assay based on detecting multiple tags simultaneously in one cell. For example, if a 20-plex assay is based upon affinity reagents labeled with Ag, In, La, Ce, Pr, Nd, Sm, Eu, Tb, Dy, Ho, Er, Tm, Yb, Lu, Hf, Re, Ir, Pt, Au, twenty time windows required to detect major isotopes of these elements can be activated, as shown in Table 2.

In practice, signal digitizers have limited time window (also called segment) re-arm time (the time from the end of a segment until a trigger will be accepted to begin another segment acquisition), of for example 150 ns; see PDA1000 1 GHz Waveform Digitizer Product information Sheet, Signatec Inc., 1138 E. Sixth Street, Corona, Calif. 92879-1615 USA. Using this particular board, only 15 segments can typically be utilized, as shown in Table 3.

TABLE 3

Segments for pre-selected elemental labels TOF-MS detection allowing 150 ns for a segment re-arm time

| Segment # | Elements | Isotopes m/z | Segment start time/ micro-second | Segment stop time/ micro-second | Number of sample points |
|---|---|---|---|---|---|
| 1 | Rh | 103 | 32.97 | 32.982 | 12 |
| 2 | Ag | 107 | 33.604 | 33.616 | 12 |
| 3 | In | 115 | 34.839 | 34.851 | 12 |
| 4 | La, Ce, Pr | 139, 140, 141 | 38.303 | 38.59 | 287 |
| 5 | Nd | 144 | 38.984 | 38.999 | 15 |
| 6 | Sm, Eu | 152, 153 | 40.052 | 40.199 | 147 |
| 7 | Tb | 159 | 40.964 | 40.979 | 15 |
| 8 | Dy, Ho, Er | 164, 165, 166 | 41.604 | 41.872 | 268 |
| 9 | Tm | 169 | 42.233 | 42.249 | 16 |
| 10 | Yb, Lu | 174, 175 | 42.852 | 42.992 | 140 |
| 11 | Hf | 180 | 43.585 | 43.602 | 17 |
| 12 | Re | 187 | 44.423 | 44.44 | 17 |
| 13 | Ir | 193 | 45.13 | 45.149 | 19 |
| 14 | Pt | 195 | 45.363 | 45.382 | 19 |
| 15 | Au | 197 | 45.596 | 45.615 | 19 |

For the acquisition described in Table 3, the total number of points per Rh-activated detection is 1015, reducing the average data generation rate to 3.05 MB/s.

This average data generation rate allows data buffering in the on-board digitizer memory and subsequent recording to the hard disk to be performed without data loss.

Example 2

Reduction of data generation rate for the apparatus presented in FIG. 2 operated at push-out frequency of 80 kHz for analysis of individual cells.

The parameters of the instrument listed in Table 1 can be changed in such a way that the time of arrival of the heaviest elemental ion of interest is below 12.5 microsecond, thus allowing operation of the TOF-MS at 80 kHz. In this example, the individual particles that are analyzed are MBA-4 cells from the human monocyte cell line derived from human hematopoetic M07E cells, as described by Sirard et. al. [Sirard C., Laneuville P., Dick J. E. Blood, 83, 1575 (1994)]. The MBA-4 cells express the myeloid cell surface antigen CD-33 and the VLA-4 antigen which can be detected by immunoassay with use of antibodies labeled with elemental tags, as described by Ornatsky et. al. [Ornatsky O., Baranov V. I., Bandura D. R., Tanner S. D., Dick J. Journal of Immunological Methods 308, 68 (2006)], incorporated here by reference.

Figure 3:
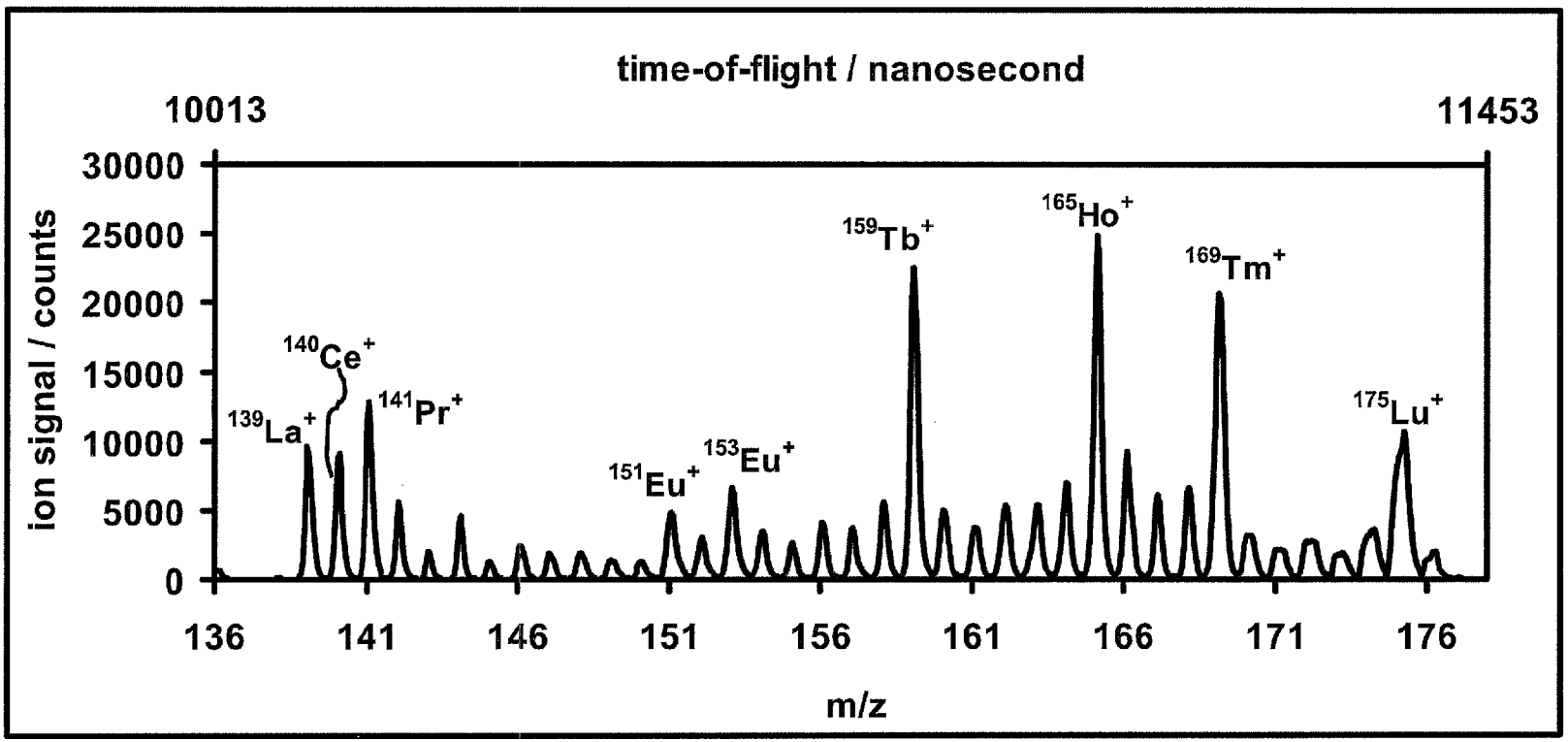
FIG. 3 shows a mass spectrum for a typical analysis of biological cells that contain multiple lanthanide-tagged antibody-antigen conjugates.

Convenient elemental tags include lanthanide atoms. FIG. 3 shows a mass spectrum measured for a sample containing a mixture of La, Ce, Pr, Nd, Sm, Eu, Gd, Tb, Dy, Ho, Er, Tm, Yb, Lu with the instrument of FIG. 2 arranged to operate at 80 kHz spectrum generation frequency. In the example described here, the CD-33 was detected with the use of antibodies labeled with Europium (Eu), and the VLA-4 was detected with the use of antibodies labeled with Tulium (Tm). The DNA of the cells was labeled with Rhodium (Rh), as described in the US patent application No. U.S. 60/772,589 filed Feb. 13, 2006 "Quantitation of cell numbers and cell size using metal labeling and elemental mass spectrometry" by Ornatsky and Baranov, incorporated here by reference. Thus, signal of $Rh^+$ ions could be used as "staining" element. From the data of FIG. 2 steps a) and b) above of the exemplary method of the embodiment can be performed.

Figure 4:
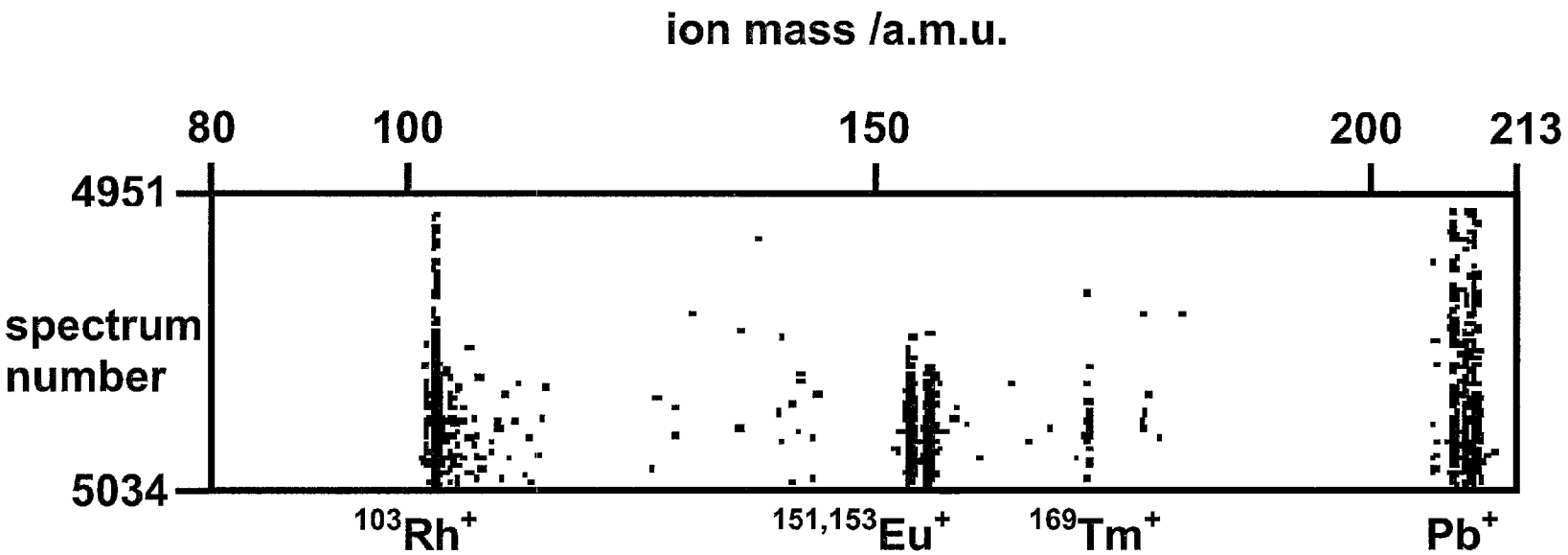
FIG. 4 shows 83 consecutive single TOF-MS spectra obtained for the sample of cells that are stained with Rh-containing staining molecule and contain lanthanide-tagged antibodies conjugated to antigens of interest.

FIG. 4 shows a three-dimensional representation of 83 consecutive mass spectra collected on an instrument according to FIG. 2 for a sample of MBA-4 cells processed in the described above way (e.g. containing Rh, Eu and Tm). As shown, there are 83 exemplary consecutive single TOF-MS spectra obtained for the sample of cells stained with Rh-containing staining molecule and containing lanthanide-tagged antibody-antigen complexes. The horizontal axis shows the mass-to-charge ratio of the detected ions (derived from their time-of-flight in a known in the art way via the instrument calibration), the vertical axis shows the number of the single spectrum acquired, and the color of the point indicates the amplitude of the electrical signal detected by the ion detector.

Figure 5:
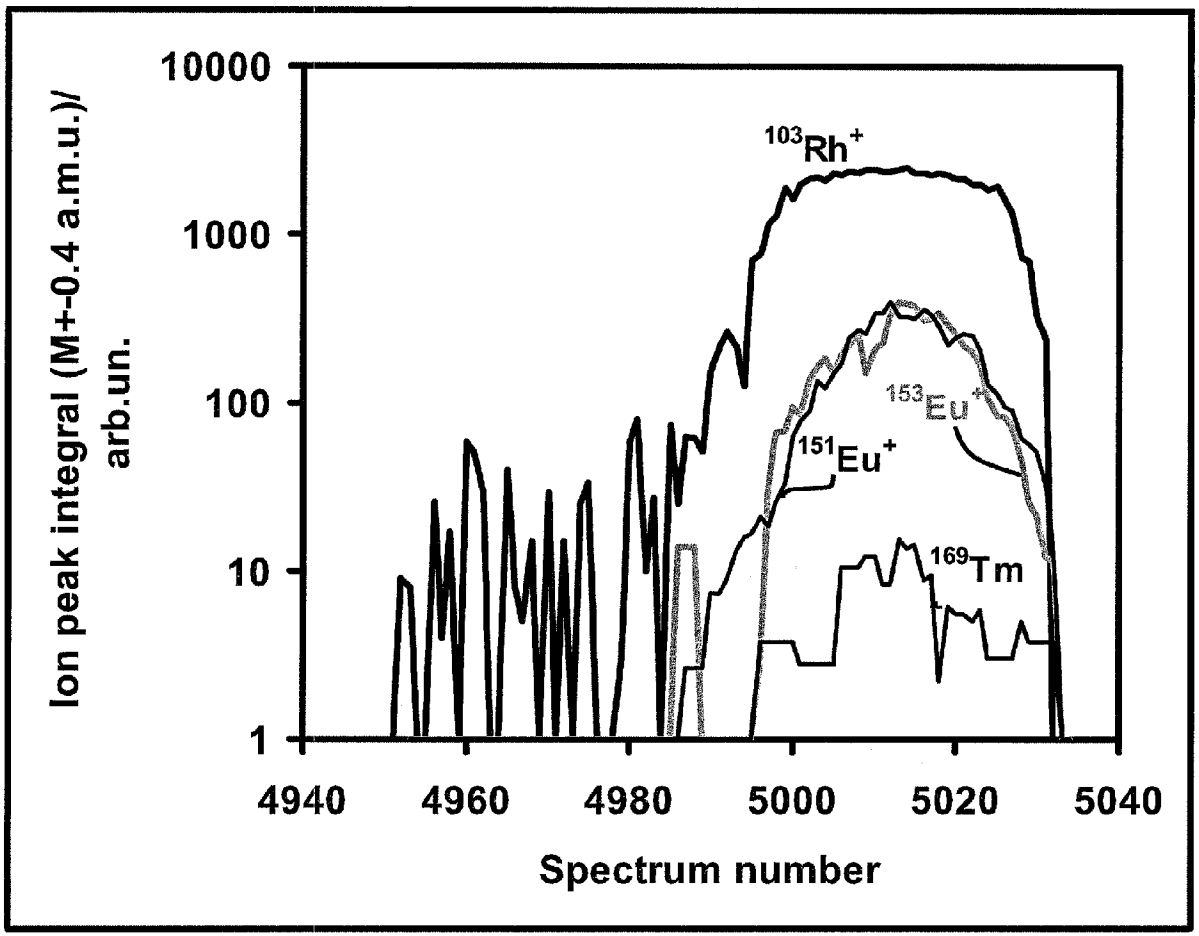
FIG. 5 shows an ion signal for the cell staining element (Rh+) for the 83 consecutive single TOF-MS spectra of FIG. 3.

FIG. 5 shows the processed data of the 83 consecutive spectra presented in FIG. 4, with integrated ion signals from multiple ions of the same nominal m/z for each scan being plotted as a function of time or the spectrum number. In FIG. 5, one can see ion signals for $Rh^+$, $Eu^+$, $Tm^+$ as a function of a spectrum number (lower abscissa) or time (upper abscissa) for the data of FIG. 4. As can be seen from the FIGS. 4 and 5, an $Rh^+$ ion signal at m/z=103, is present in most of the spectra. This means that Rh atoms are present in the sample buffer (which is continuously aspirated into the ICP) or in the sampling tubing or other components of the sample introduction system. However, the strength of this "background" Rh+ signal is below 100 arbitrary unit (arb. un.) up until spectrum #4990, after which it rapidly rises and reaches saturation at a level of approximately 2000. It is seen from FIGS. 4 and 5 that the signals from Eu+ and Tm+ appear only when Rh+ signal starts to rise above the selected threshold of 100 arb.un. in the exemplary embodiment. This simultaneous rise of signals of Rh+, Eu+ and Tm+ is attributed to the arrival of a single cell-produced ion cloud into the TOF section of the instrument of FIG. 2. The Pb+ ion signal is constantly present because Pb is impurity in the sample buffer and not in the cells. Thus, there is no need to sample the ion signal waveform in more than the first time window (corresponding to Rh+ signal) until the Rh+ signal strength is above the selected threshold of 100 arb.un. Only the time window in which Rh+ signal appears (~15 ns, as can be determined from the data of FIG. 3) needs to be sampled for each single ion signal waveform, e.g. only 15 data points for the 1 GHz detection system are collected every 12.5 microsecond.

The continuous data collection rate is thus only 1.2 MB/s (for 8-bit dynamic range), and the data can be easily transferred and handled without data loss. The second ion signal waveform sampling time window which covers the mass range of 150-169 and is approximately 700 ns wide, can be activated only for spectra from #4991 to #5010, when the signal in the first time window is above the selected threshold of 100 arb.un. without loss of significant information for detection of Eu and Tm from the cell-induced ion cloud. The cells are introduced into the instrument at a rate of approximately 1000 per second. The 14 kB of the data collected in the 20 spectra #150-169 can be transferred during approximately 700 microsecond, before the next cell-induced ion cloud enters the TOF section, at an effective rate of 20 MB/s. Even if the second time window is selected in such a manner that the ion signal waveform is sampled for all ions of m/z>100 in spectra #4991 to #5010, the required data transfer rate is less than 60 MB/s, which can be easily handled with available technology.

As will be apparent to those skilled in the relevant arts, once they have been made familiar with this disclosure, the second time window can be activated even later than the appearance of the $Rh^+$ signal above the pre-selected threshold of 100 arb.un.—either by setting up an appropriate time delay of by selecting a different threshold of Rh+ for activating the second time window.

Example 3

Reduction of data generation rate by collecting ions on other than TOF detector.

The DNA of a cell is very abundant: 10 billion base pairs can be present. If every base pair is labeled with a staining element, for example, $Rh^+$, as described in the US patent application No. U.S. 60/772,589 filed Feb. 13, 2006 "Quantitation of cell numbers and cell size using metal labeling and elemental mass spectrometry" by Ornatsky and Baranov, total Rh abundance can be in excess of 1010 atoms per cell. The following consideration is given to the ion transmission factors at different points of the instrument shown in FIG. 2:

3.1. ionization efficiency in the ICP plasma. The cell is completely atomized in plasma, and Rh degree of ionization for a typical ICP is 99%

3.2. The combined efficiency of ion transport from the plasma through the sampler 90 and skimmer 100 is approximately 1%

3.3. The transmission of ion optics 110-140 is typically 10%

3.4. The multipole rf ion transmission device 160 is typically 20% efficient 3.5. The time-of-flight analyzer in a non-reflecting geometry is typically 20% efficient The resulting number of Rh.sup.+ ions in a cell-induced ion cloud collected by one of the collectors positioned at different points along the ion path per single cell can be evaluated as follows:

Collectors 360 or 120: $10^7$ ions

Collector 350: $2\times10^6$ ions

Collector 230: $2\times10^6$ ions

Collector 370: $4\times10^5$ ions

Although the numbers above are the lower estimates only, and since in practice there will be more than one atom of Rh attached to a base pair of a cell DNA, it is clear that such ion numbers are well above the noise level of a typical charge sensitive amplifier (<1000 electrons RMS) and thus can be easily detected.

Thus, a decision to activate the second ion detection time window can be based not only on the signal detected from the "staining element" in the first detection window, but instead, or in addition to, by detecting the "staining element" on one of the collectors or ion detectors (230, 350, 360, 370) shown in FIG. 2.

A signal from the ion detectors 230, 350, 360, 370 can be also used for switching the potentials of the electrodes of the system to allow ions to be transmitted to the detector 240 only when a signal on one or more of the ion detectors is above a certain threshold. For example, grid electrode 210 can be biased to a potential to either allow ions to pass through or to be deflected back towards the detector 240. The switch between these two states can be done between two single push-outs, after the signal of the "staining element" detected on the collector 370 is above a certain threshold.

Example 4

Reduction of data generation rate by collecting photon emission induced by the "staining element"

Ion collector 120 in this example is substituted with a photo-detector which detects emission characteristic of the atoms and ions of the staining element introduced into the ICP. When the cell which contains abundant "staining element", for example, Rh, the emission lines characteristic of RhI and RhII excited in the plasma, will be readily detectable above background, as known in the art of inductively coupled plasma optical emission spectroscopy.

Example 5

Reduction of data generation rate by collecting neutral component of a particle that partially survived ionization in the ICP.

Figure 6:
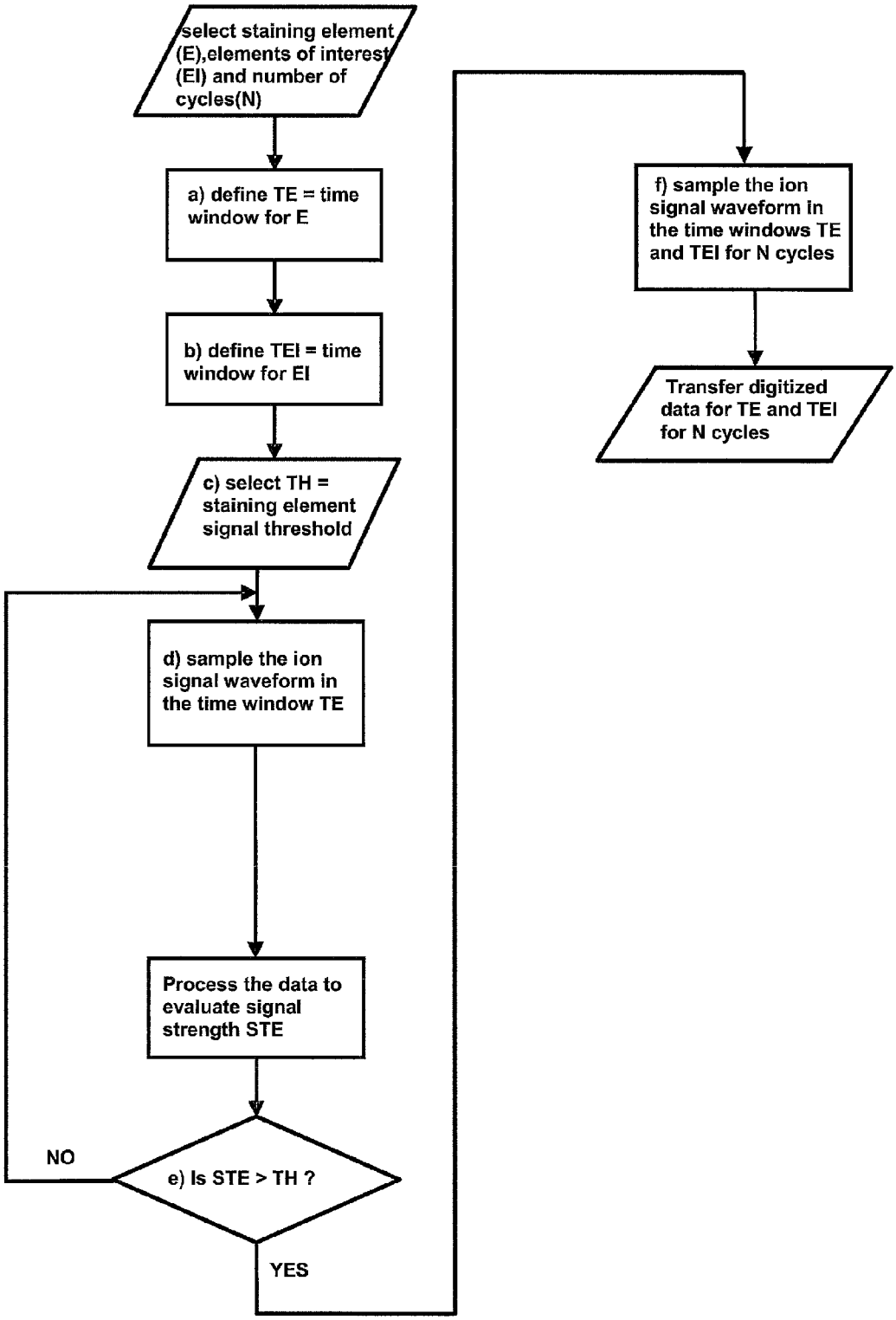
FIG. 6 shows a flow chart of an example of how a method according to the invention can be applied for reduction of the data generation rate.

Ion collector 120 in this example is substituted with a secondary electron multiplier which can detect neutral energetic clusters, as described, for example, by Piseri et al. The part of the particle that survives ionization, after expansion through the interface 100, can acquire velocity as high as 3 km/s, which makes its impact on a particle-sensitive surface of the multiplier energetic enough to induce secondary electron emission. This signal can be used to detect the presence of the particle while the ionized component of the particle is deflected by the deflector 110 and can be used for mass spectrometry elemental analysis. This can be seen in FIG. 6, which shows a summary of an exemplary method for reduction of the data generation rate.

Example 6

Figure 7:
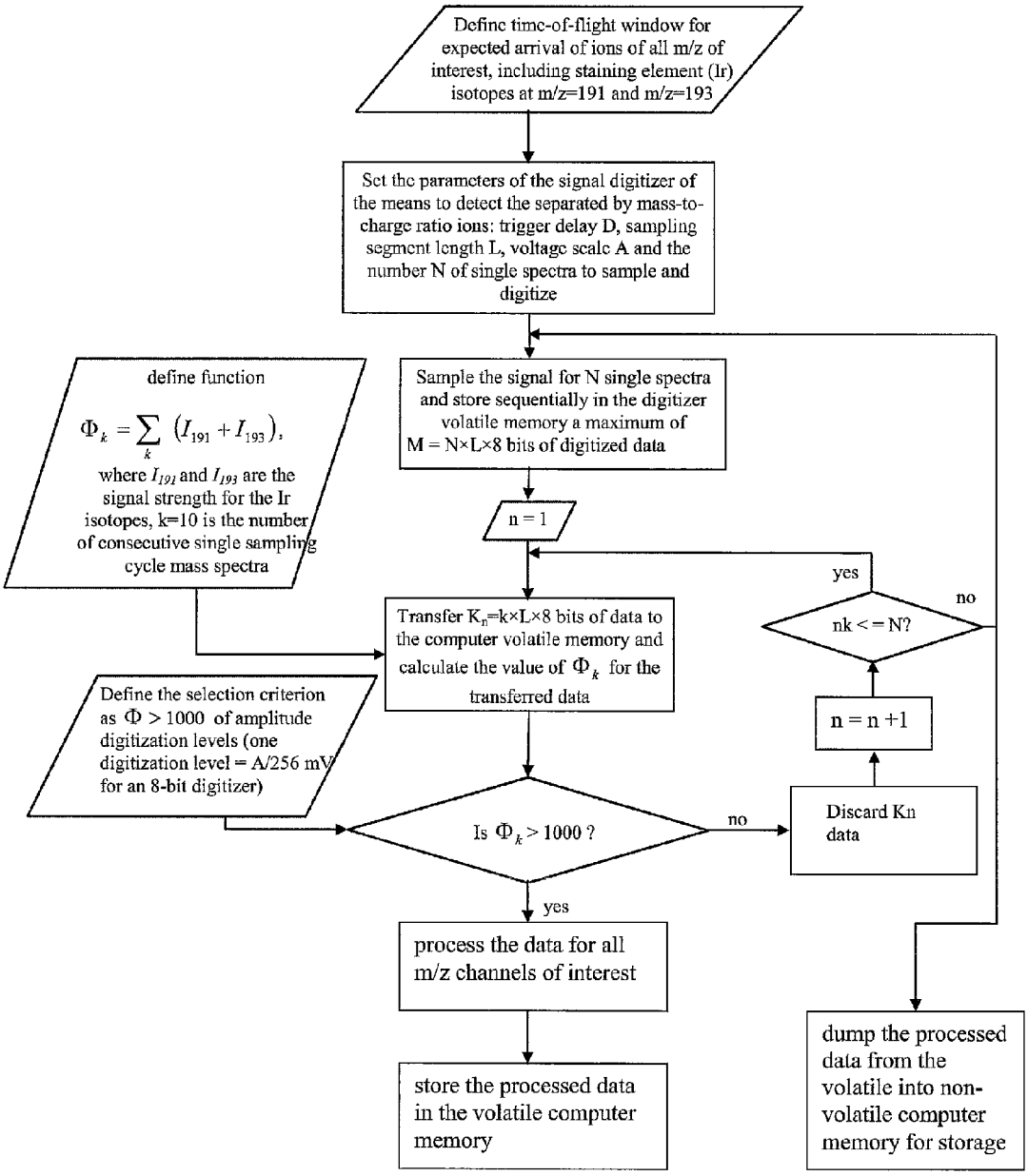
FIG. 7 shows a flow chart of an example of a method according to the invention as applied to reduction of the load of the data to be processed and stored.

Reduction of data storage rate according to an exemplary method of the invention illustrated by FIG. 7 for the apparatus of FIG. 2 operated at a push-out frequency of 55 kHz for the analysis of individual cells. The flow chart of FIG. 7 shows an exemplary method for reducing data recording load according to the invention.

Figures 1, 8A:
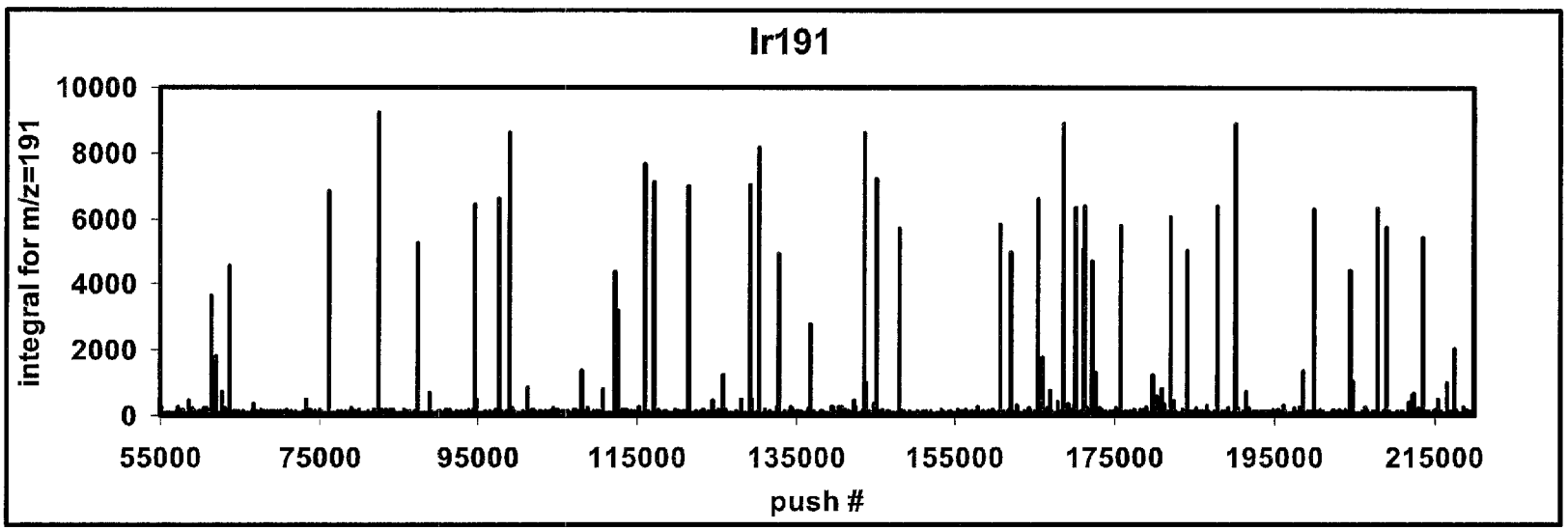
Figures 2, 8A:
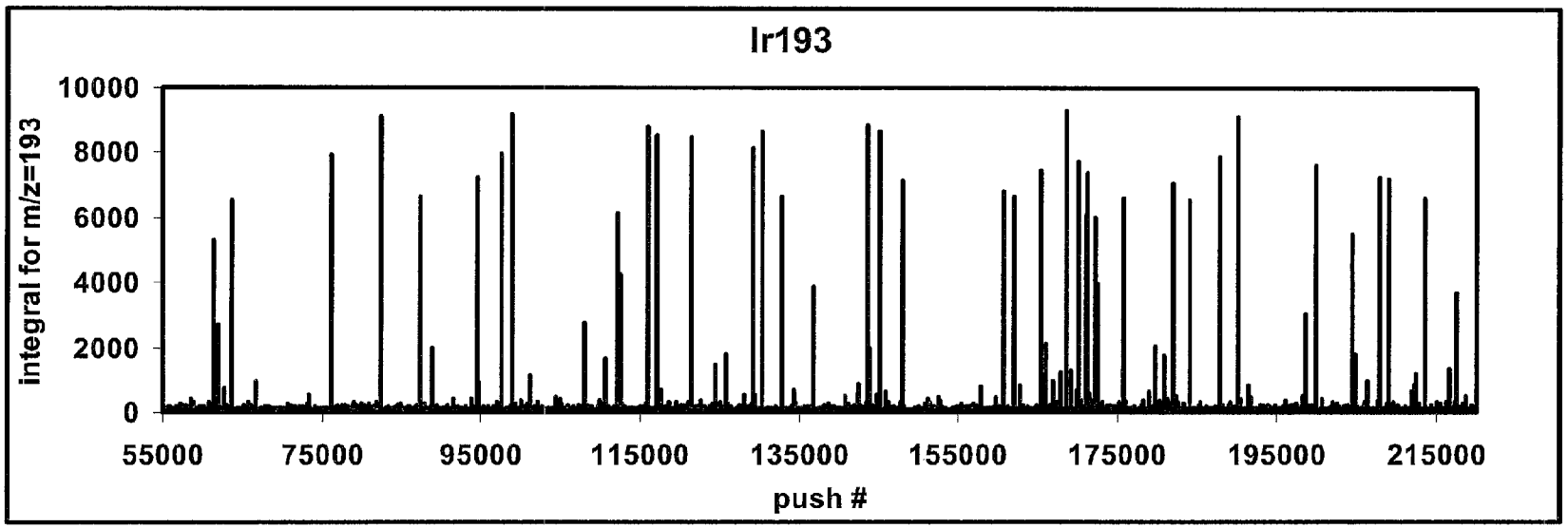
Figures 3, 8A:
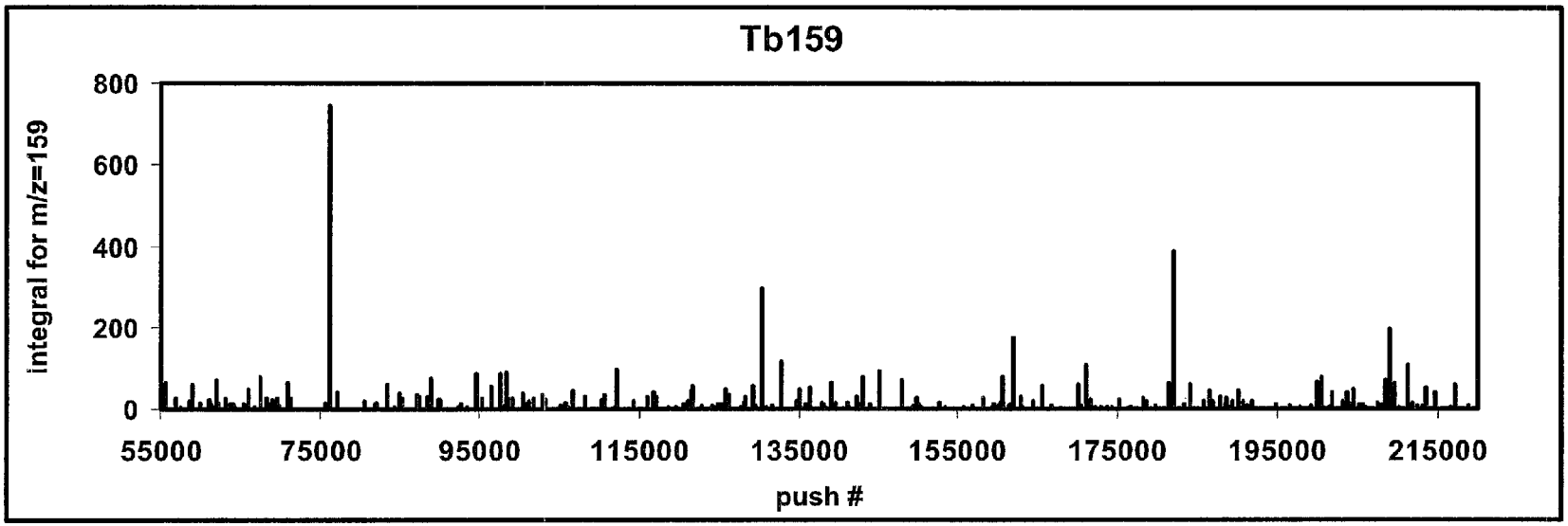
Figures 4, 8A:
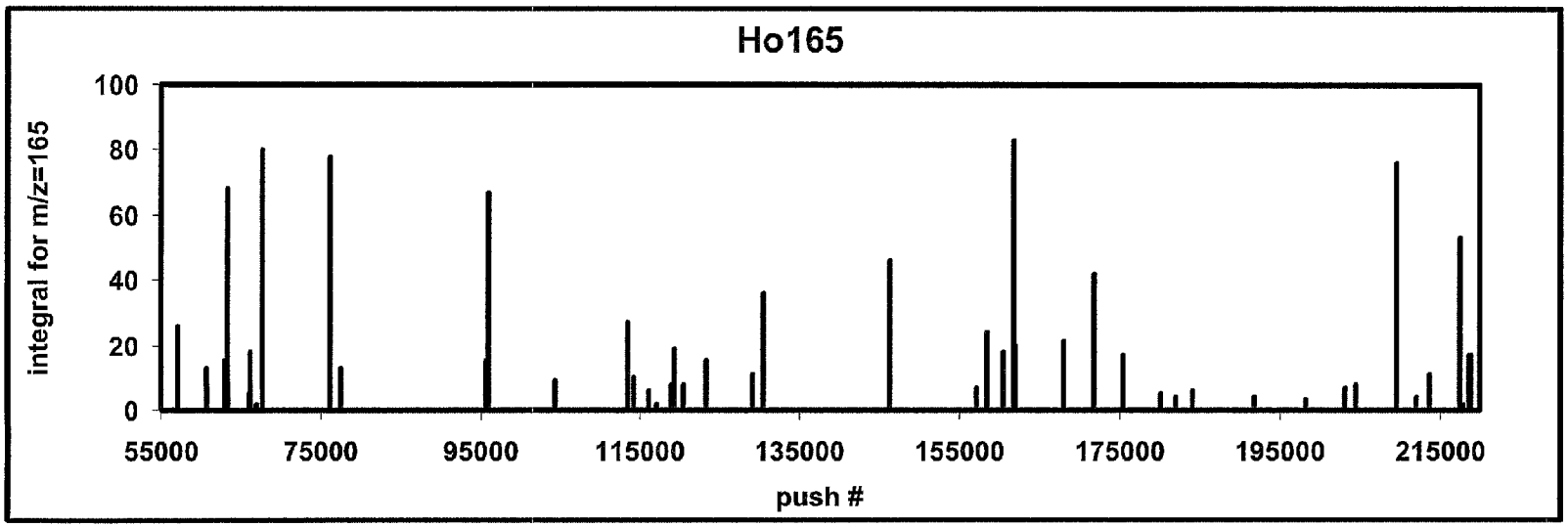
Figures 5, 8A:
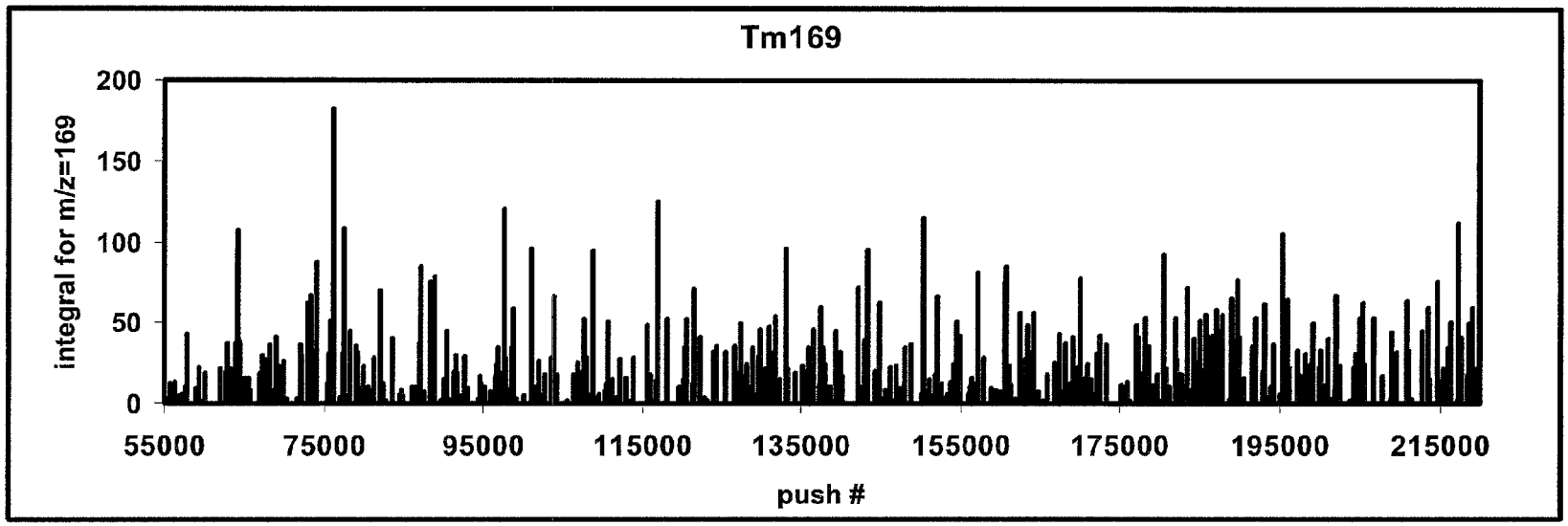
Figure 8B:
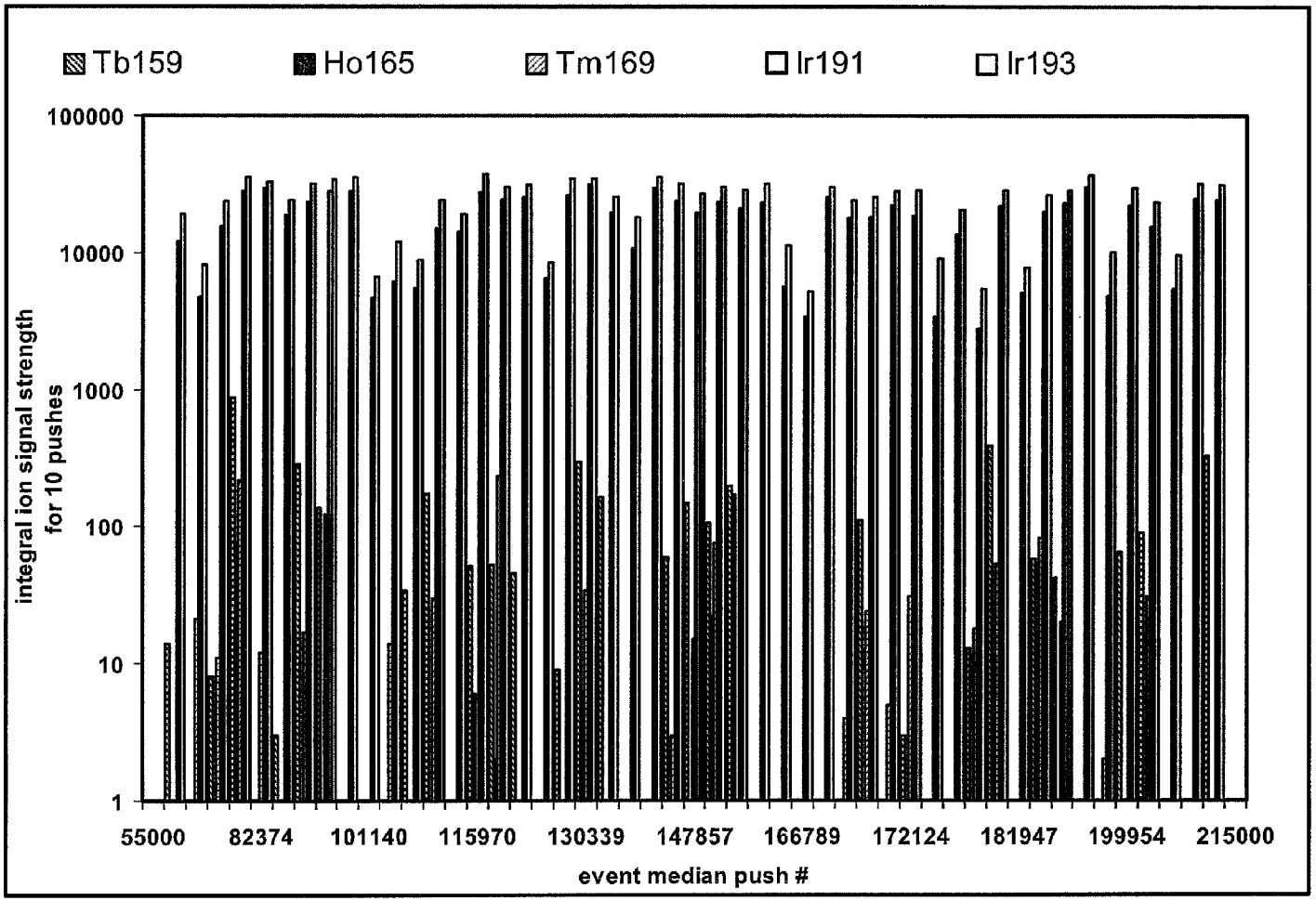

In this example, the KG1a cells were stained by element Ir, which has two isotopes: $^{191}Ir$ and $^{193}Ir$, of natural ratio of abundances of $^{191}Ir/^{193}Ir=1/1.68$. The cells are also immunointerrogated for CD-34, CD-45 and CD-38 proteins by antibodies labeled with metals: Tb-CD-45, Ho-CD-38 and Tm-CD-34. FIG. 8A shows the data collected for five mass-to-charge ratio channels: m/z=159 (Tb), m/z=165 (Ho); m/z=169 (Tm), m/z=191 ($^{191}Ir$) and m/z=193 ($^{193}Ir$) for all single mass spectra within 3 seconds of the experiment. Thus in FIGS. 8A-1 through 8A-5, there is seen data for cells KG1a stained with Ir (FIGS. 8A-1 and 8A-2) and immuno-stained with Tb-CD-45 (FIG. 8A-3), Ho-CD-38 (FIG. 8A-4) and Tm-CD-34 (FIG. 8A-5) antibodies collected for 3s, with all five mass-to-charge ratio channels shown for each single sampling cycle mass spectrum. For each single sampling cycle mass spectrum, a time window of 30 ns was selected for each m/z, and all signals within a time window were summed to produce for each single mass spectrum one set of five 2-Byte numbers indicating signal strength for each element. The resulting data occupies 1.65 MB of the computer volatile memory (RAM). The data for the primary detection channels, m/z=191 and m/z=193 only, was further processed in order to detect particle presence. The function according to an exemplary embodiment was selected as a sum of signal strength of $^{191}Ir$ and $^{193}Ir$ in 10 consecutive mass spectra. It is noted that the 10 consecutive mass spectra have a combined duration of approximately 180 microsecond, which approximates the duration of the cell-induced ion cloud. The exemplary selection criterion of the particle presence in the mass spectrometer was selected as the function value being above 7000. If the selection criterion is satisfied, the other, secondary detection channels are processed. The resulting data of the full processing is then stored in a computer non-volatile memory (hard drive). The data indicates that only 39 groups of 10 consecutive single spectra satisfied the selection criterion and were qualified as indicating the presence of a cell in the mass spectrometer (see FIG. 8B, showing data of shown in FIGS.

8A-1 through 8A-5 processed according to an exemplary method of the invention illustrated with reference to FIG. 7). The data requires only 0.8 kB of memory, thus the reduction of the load on a disk recording system of more than 3 orders of magnitude is achieved.

In other embodiments, other functions, such as functions related to signal strength, can be used. Such exemplary functions can relate to selected single, sum, ratio or integral of signal strength(s).

The above described exemplary methods may be implemented using hardware, software or hardware and software combinations consistent with the purposes described herein, including a wide variety of such devices known to those skilled in the relevant arts. For example, the described methods for elemental analysis of particles by mass spectrometry can be implemented using computer readable code stored on a computer readable medium. A mass spectrometer with hardware and/or software components customized for elemental analysis of particles may also be used in some embodiments.

While the foregoing invention has been described in some detail for purposes of clarity and understanding, it will be appreciated by those skilled in the relevant arts, once they have been made familiar with this disclosure, that various changes in form and detail can be made without departing from the true scope of the invention in the appended claims. The invention is therefore not to be limited to the exact components or details of methodology or construction set forth above. Except to the extent necessary or inherent in the processes themselves, no particular order to steps or stages of methods or processes described in this disclosure, including the Figures, is intended or implied. In many cases the order of process steps may be varied without changing the purpose, effect, or import of the methods described.

What is claimed is:

1. A mass spectrometer for elemental analysis of a particle, the mass spectrometer comprising:

a particle introduction system;

an inductively-coupled plasma source positioned downstream of the particle introduction system, the inductively-coupled plasma source being configured to produce ions and light emission from staining elements associated with the particle;

an ion mass-to-charge ratio analyzer positioned downstream of the inductively-coupled plasma source, the analyzer being configured to separate ions according to their mass-to-charge ratio;

a main ion detector for detecting the separated ions and producing data output;

a digitizer for digitizing the output;

a data transfer channel for transferring the digitized data output;

at least one of a data processor and a data recorder to receive the digitized data output;

a particle presence detector in the mass spectrometer having an activation corresponding with the detection of the light emission of a particle to be analyzed in the mass spectrometer; and a synchronizer having an activation input from the particle presence detector and that synchronizes with a command output to at least one of the main ion detector, the digitizer, the data transfer channel, the data processor and the data recorder; wherein the particle presence detector in the mass spectrometer triggers the synchronizer.

2. The mass spectrometer according to claim 1, wherein the particle presence detector is positioned downstream of the inductively-coupled plasma source in the mass spectrometer.

3. The mass spectrometer according to claim 1, wherein the particle presence detector in the mass spectrometer comprises a photon detector.

4. A mass spectrometer for elemental analysis of a particle, comprising:

a particle introduction system;

an inductively-coupled plasma source positioned downstream of the particle introduction system, the inductively-coupled plasma source being configured to produce ions and changes in light emission characteristics of the plasma from staining elements associated with the particle;

an ion mass-to-charge ratio analyzer positioned downstream of the inductively-coupled plasma source, the analyzer being configured to separate ions according to their mass-to-charge ratio;

a main ion detector for detecting the separated ions and producing data output;

a digitizer for digitizing the output;

a data transfer channel for transferring the digitized data output;

at least one of a data processor and a data recorder to receive the digitized data output; and a photon detector having an activation corresponding with the detection of the changes in light emission characteristics of the plasma of a particle to be analyzed in the mass spectrometer.

5. The mass spectrometer according to claim 4, further comprising a synchronizer having an activation input from the photon detector and that synchronizes with a command output to at least one of the main ion detector, the digitizer, the data transfer channel, the data processor and the data recorder; wherein the detection of the changes in light emission characteristics of the plasma triggers the synchronizer.

6. The mass spectrometer according to claim 4, wherein the photon detector is positioned downstream of the inductively-coupled plasma source.

* * * * *